US007448990B2

(12) United States Patent
Wu

(10) Patent No.: US 7,448,990 B2
(45) Date of Patent: Nov. 11, 2008

(54) PULL EXERCISER

(76) Inventor: Ying-Ching Wu, No. 25, Shin-Chi Village, An-Ding Shiang, Tainan County (TW)

( * ) Notice: Subject to any disclaimer, the term of this patent is extended or adjusted under 35 U.S.C. 154(b) by 16 days.

(21) Appl. No.: 11/668,727

(22) Filed: Jan. 30, 2007

(65) Prior Publication Data

US 2008/0182734 A1 Jul. 31, 2008

(51) Int. Cl.
*A63B 21/02* (2006.01)

(52) U.S. Cl. ..... 482/121; 482/124; 482/123; 482/126; 482/91

(58) Field of Classification Search ..... 482/91, 482/121, 49, 126, 139, 123, 124
See application file for complete search history.

(56) References Cited

U.S. PATENT DOCUMENTS

| | | | | |
|---|---|---|---|---|
| 1,524,108 | A | 1/1925 | Rowland | |
| 4,225,131 | A | 9/1980 | Sidlinger et al. | |
| 4,733,862 | A | 3/1988 | Miller | |
| 5,431,617 | A | 7/1995 | Rattray, Jr. | |
| 5,556,368 | A | 9/1996 | Akin | |
| 5,620,397 | A * | 4/1997 | Chieh | 482/46 |
| 5,885,196 | A | 3/1999 | Gvoich | |
| 6,244,998 | B1 | 6/2001 | Hinds | |
| 6,402,668 | B1 | 6/2002 | Harker | |
| 6,405,929 | B1 | 6/2002 | Ehrhart et al. | |
| 6,497,641 | B1 | 12/2002 | Hinds | |
| 6,500,105 | B1 | 12/2002 | Kuo | |
| 6,524,226 | B2 | 2/2003 | Kushner | |
| 6,676,576 | B1 | 1/2004 | Wu | |
| 6,932,747 | B2 * | 8/2005 | Herman | 482/126 |
| 6,979,286 | B1 * | 12/2005 | Hinds | 482/121 |
| 7,179,211 | B2 * | 2/2007 | Broadwater | 482/126 |
| 2005/0075223 | A1 | 4/2005 | Wu | |
| 2005/0137066 | A1 | 6/2005 | Wu | |

* cited by examiner

*Primary Examiner*—Fenn C Mathew
*Assistant Examiner*—Robert F Long
(74) *Attorney, Agent, or Firm*—Alan Kamrath; Kamrath & Associates PA

(57) ABSTRACT

A pull exerciser includes a plurality of elastic cords of different elastic coefficients and a plurality of handles. The plurality of elastic cords are connected in series. Adjacent ends respectively of a pair of elastic cords adjacent to each other are securely held by an associated handle. Each handle includes a longitudinal hole having two end openings. Each end opening is extended through by an associated one of the ends of the plurality of elastic cords and has a minimum inner diameter smaller than a maximum outer diameter of the associated end of the associated elastic cord, thereby securely engaging the adjacent ends of the pair of elastic cords and an associated handle together.

16 Claims, 7 Drawing Sheets

PULL EXERCISER

BACKGROUND OF THE INVENTION

1. Field of the Invention

The present invention relates to a pull exerciser and, more particularly, to a pull exerciser including stretchable elastic cords for exercising purposes.

2. Description of the Related Art

Pull exercisers with elastic cords allowing exercise of muscles of the breasts and arms of users are popular, for they are light and small and, thus, easy to carry. There are various types of pull exercisers, and a typical one includes two handles and at least one elastic cord between the handles, allowing a user to repeatedly stretch and release the cord for exercising purposes.

The handles and the elastic cord are secured together to avoid separation, leading to difficulty in replacement of elastic cords of various elastic coefficients. Thus, the user can only exercise with a single elastic force. However, different users of different ages or sizes or the same user under different situations might require exercise with different elastic cords of different elastic coefficients. Thus, there is a need of a pull exerciser with different elastic cords of different elastic coefficients.

SUMMARY OF THE INVENTION

The present invention solves this need and other problems in the field of pull exercisers by providing, in a preferred form, a pull exerciser including a plurality of elastic cords of different elastic coefficients and a plurality of handles. The plurality of elastic cords are connected in series. Adjacent ends respectively of a pair of elastic cords adjacent to each other are securely held by an associated handle. Each handle includes a longitudinal hole having two end openings. Each end opening is extended through by an associated end of an associated elastic cord and has a minimum inner diameter smaller than a maximum outer diameter of the associated end of the associated elastic cord, thereby securely engaging the adjacent ends of the pair of elastic cords and an associated handle together.

In a preferred form, the plurality of elastic cords are connected to form a loop. In another preferred form, the plurality of elastic cords are connected in a line, and each of two outermost handles has an outer end free of elastic cord.

In a preferred form, each handle includes a first handle part and a second handle part. Each of the first and second handle parts includes an outer end defining the end opening and an inner end. The inner ends of the first and second handle parts are releasably coupled with each other. The inner end of each first handle part includes a first protrusion formed on an end face thereof. The first protrusion includes a groove defined in an outer periphery thereof and having an open end and a closed end. The inner end of each second handle part includes a first rib on an inner periphery thereof. The first rib is insertable through the open end of the groove into the groove of the first protrusion for coupling the first and second handle parts together. In the most preferred form, the inner end of each first handle part further includes a second protrusion formed on the end face thereof and circumferentially spaced from the first protrusion. The second protrusion includes a groove defined in an outer periphery thereof and having an open end and a closed end. The inner end of each second handle part includes a second rib on the inner periphery thereof and circumferentially spaced from the first rib. The second rib is insertable through the open end of the groove of the second protrusion into the groove of the second protrusion for coupling the first and second handle parts together.

In the preferred form, each of the first and second handle parts further includes a lining ring mounted in the outer end thereof. Each lining ring has an outer diameter greater than the minimum inner diameter of an associated end opening. Each lining ring includes an axial hole having a minimum inner diameter smaller than the maximum outer diameter of the associated end of the associated elastic cord.

In the most preferred form, the inner end of each of the first and second handle parts includes a reduced section in the outer end thereof. The reduced section has an inner diameter smaller than the outer diameter of an associated lining member. Each lining ring is substantially C-shaped, and the axial hole of each lining ring is delimited by a conic inner periphery that tapers outward.

In the most preferred form, each end of each elastic cord is tubular and has a plug mounted therein. The plug includes an outer diameter tapering outward. The outer diameter of the plug is greater than an inner diameter of an associated end of an associated elastic cord. An overall outer diameter of the associated end of the associated elastic cord having the plug mounted therein is greater than the minimum inner diameter of an associated lining ring. Each end of each elastic cord is folded outward and backward to form a folded, outer layer having a length greater than the associated plug.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
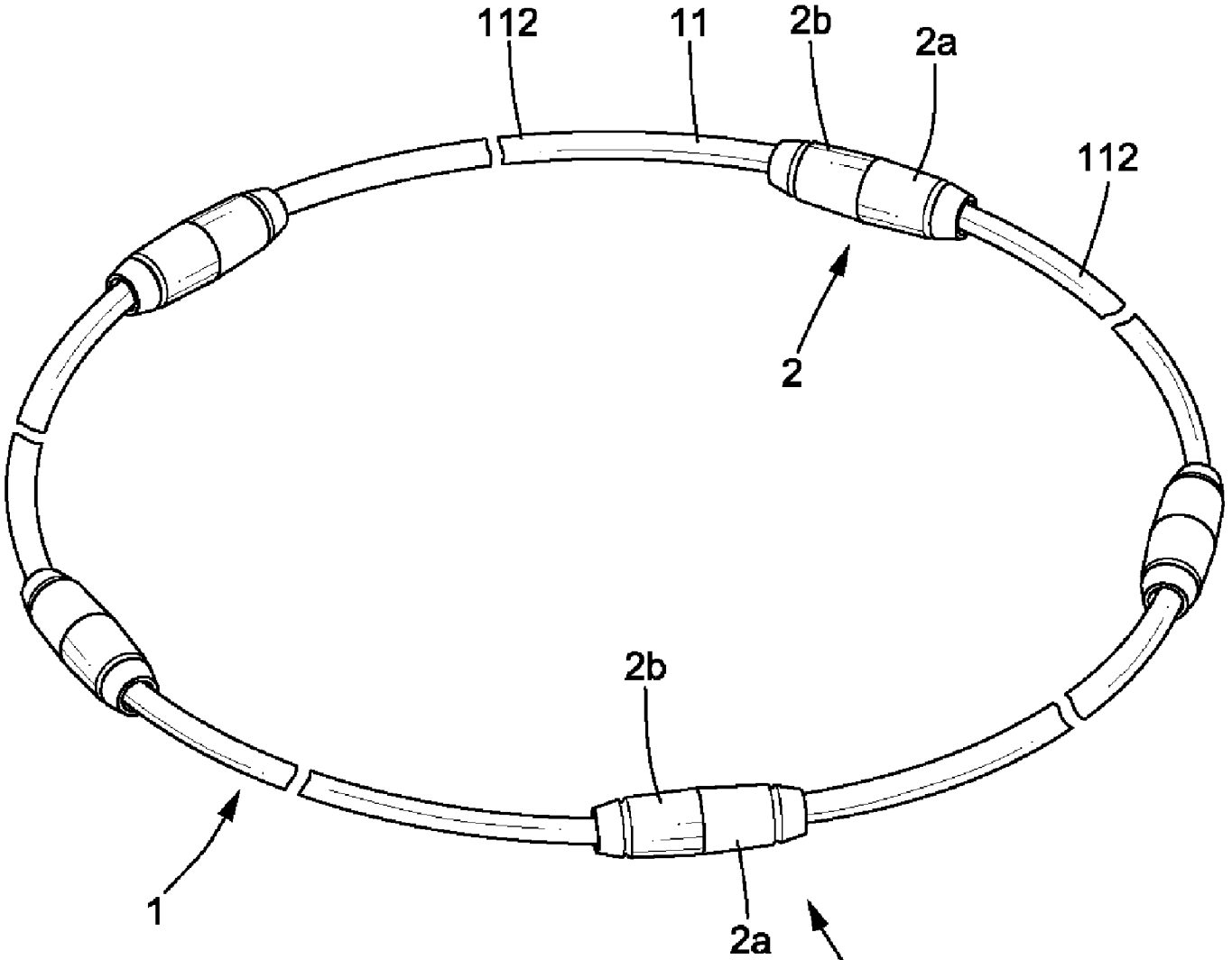
FIG. 1 is a perspective view of an example of a pull exerciser according to the preferred teachings of the present invention.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "end", "part", "longitudinal", "axial", "circumferential", "diametrical", "outward", "inward", "length", and similar terms are used herein, it should be understood that these terms have reference only to the structure shown in the drawings as it would appear to a person viewing the drawings and are utilized only to facilitate describing the invention.

DETAILED DESCRIPTION OF THE PREFERRED EMBODIMENTS

An example of a pull exerciser according to the preferred teachings of the present invention includes an elastic cord assembly 1 having a plurality of handles 2. In the example shown, the elastic cord assembly 1 includes five elastic cords 11 of different elastic coefficients and five handles 2, wherein the elastic cords 11 are connected in series by the handles 2 to form a loop. In a preferred form shown, each elastic cord 11 is tubular and includes two ends 111 and an intermediate portion 112 between the ends 111. A plug 12 is mounted in each end 111 of each elastic cord 11. In the preferred form shown, each plug 12 is a truncated cone tapering outward and having a maximum outer diameter greater than an inner diameter of an associated end 111 of an associated cord 11. The respective plugs 12 are forcibly inserted into the respective ends 111 of the respective cords 11 and hence expand or bulge the respective ends 111 of the respective elastic cords 11. In the preferred form shown, the outer end 111 of each cord 11 is folded outward and backward to form a folded, outer layer 113 having a length preferably greater than that of the plug 12. Thus, the plugs 12 can be reliably retained in place.

Figure 2:
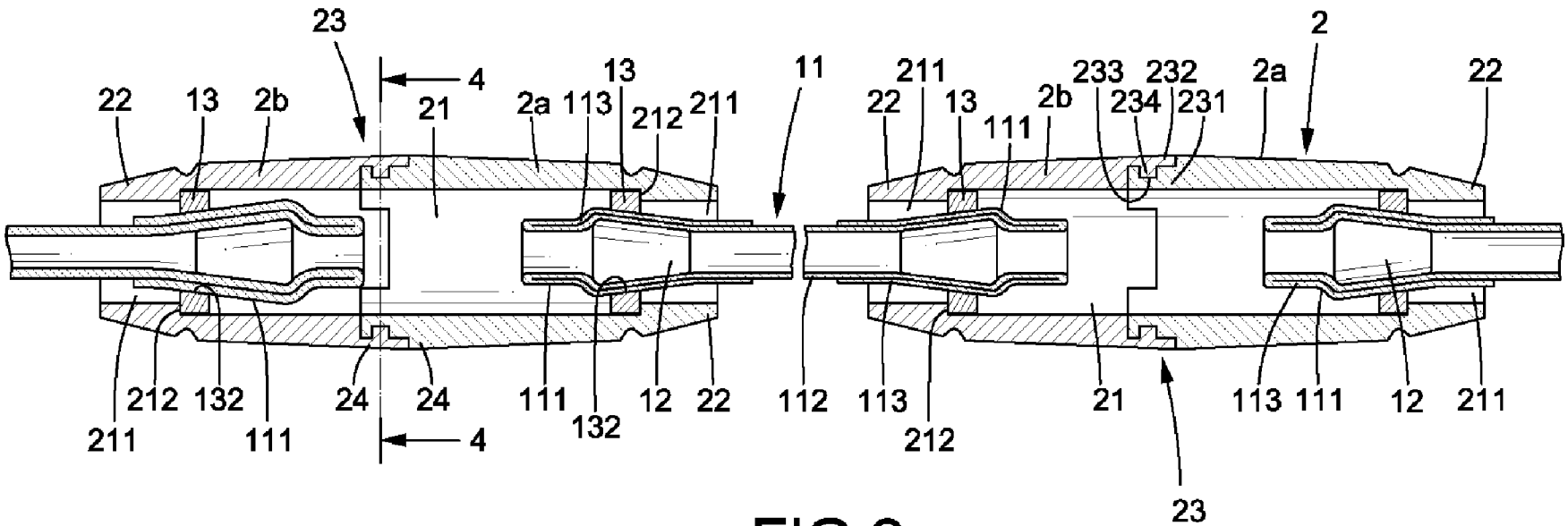
FIG. 2 is a partial sectional view of the pull exerciser in FIG. 1.
Figure 3:
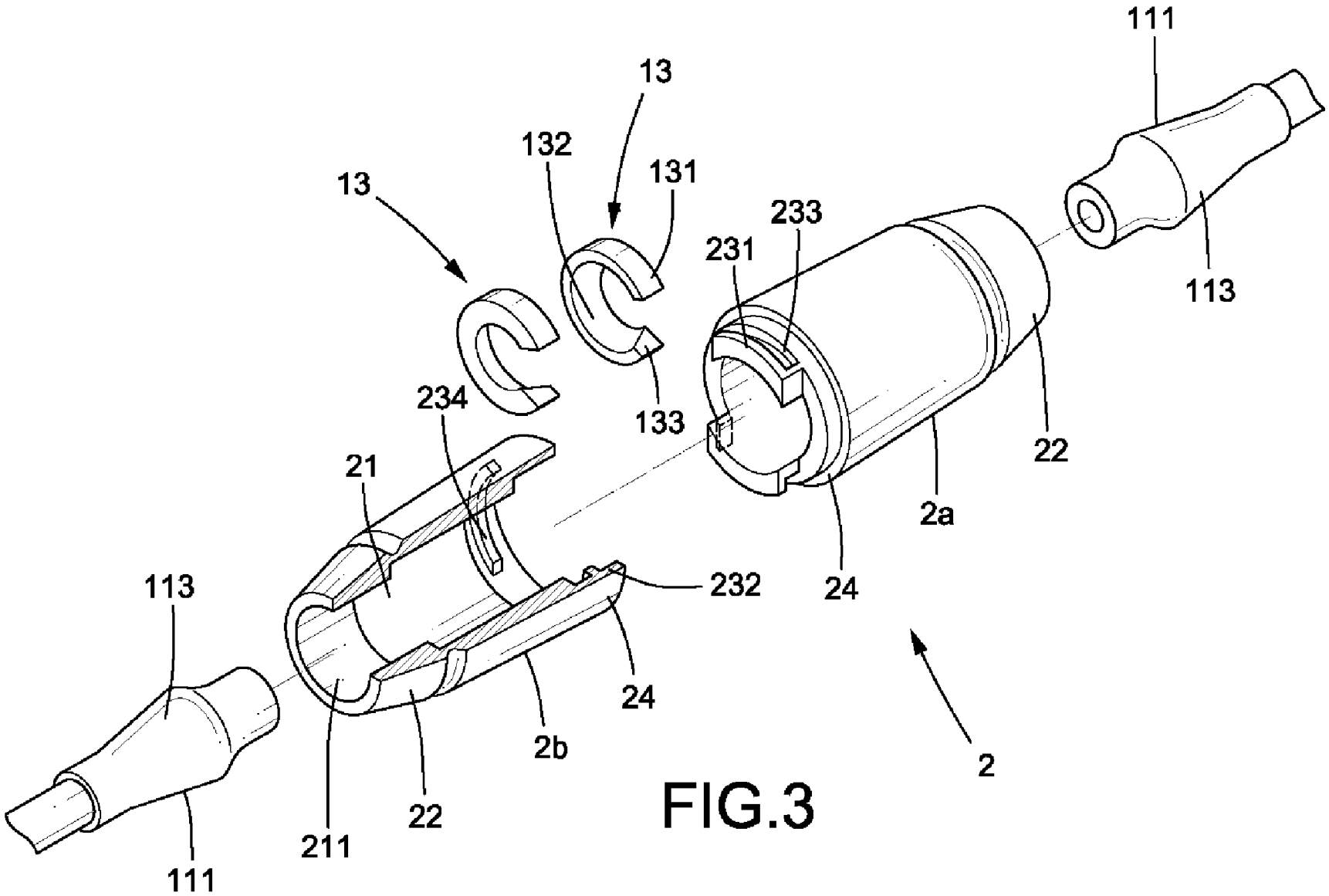
FIG. 3 is a partial exploded perspective view of the pull exerciser in FIG. 1.
Figure 4:
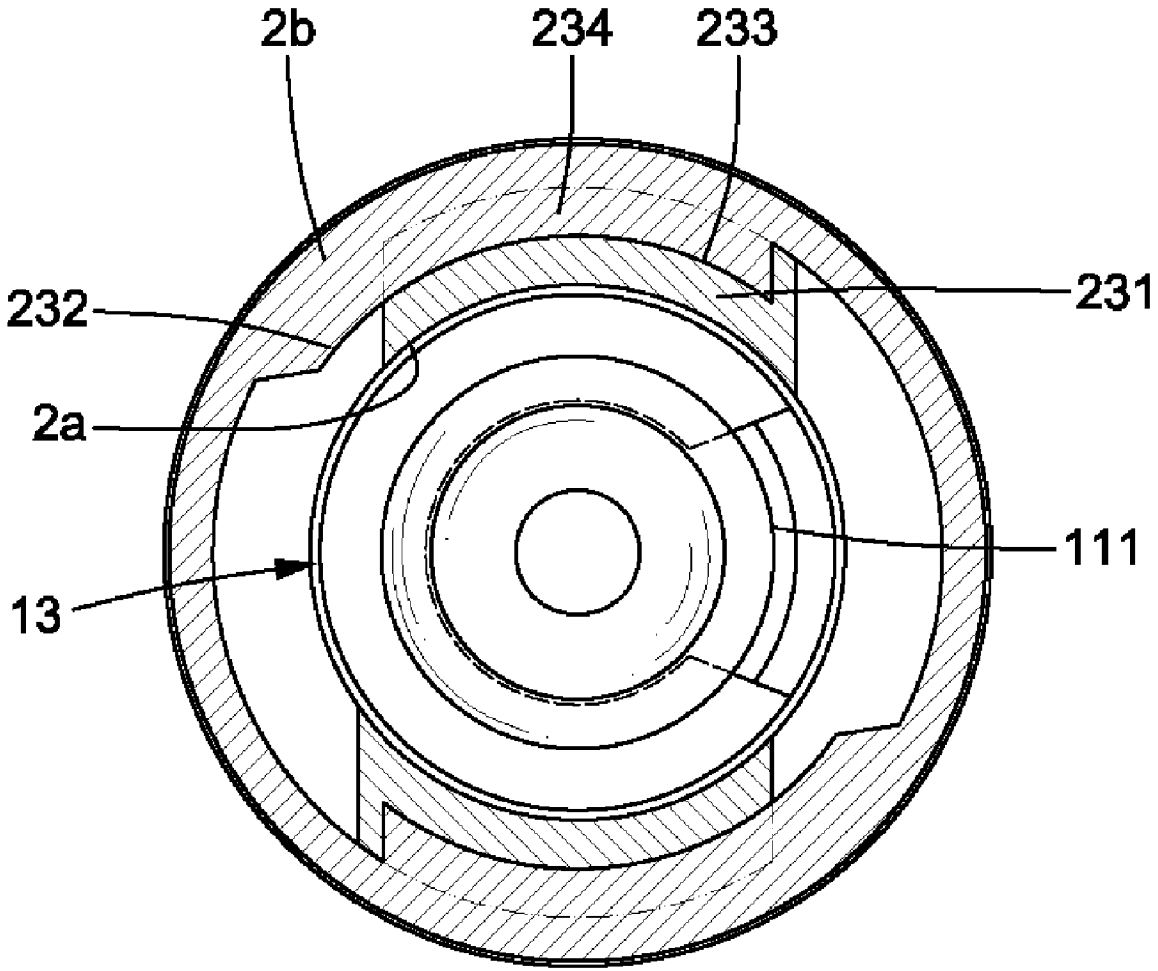
FIG. 4 is a sectional view taken along plane 4-4 in FIG. 2.
Figure 5:
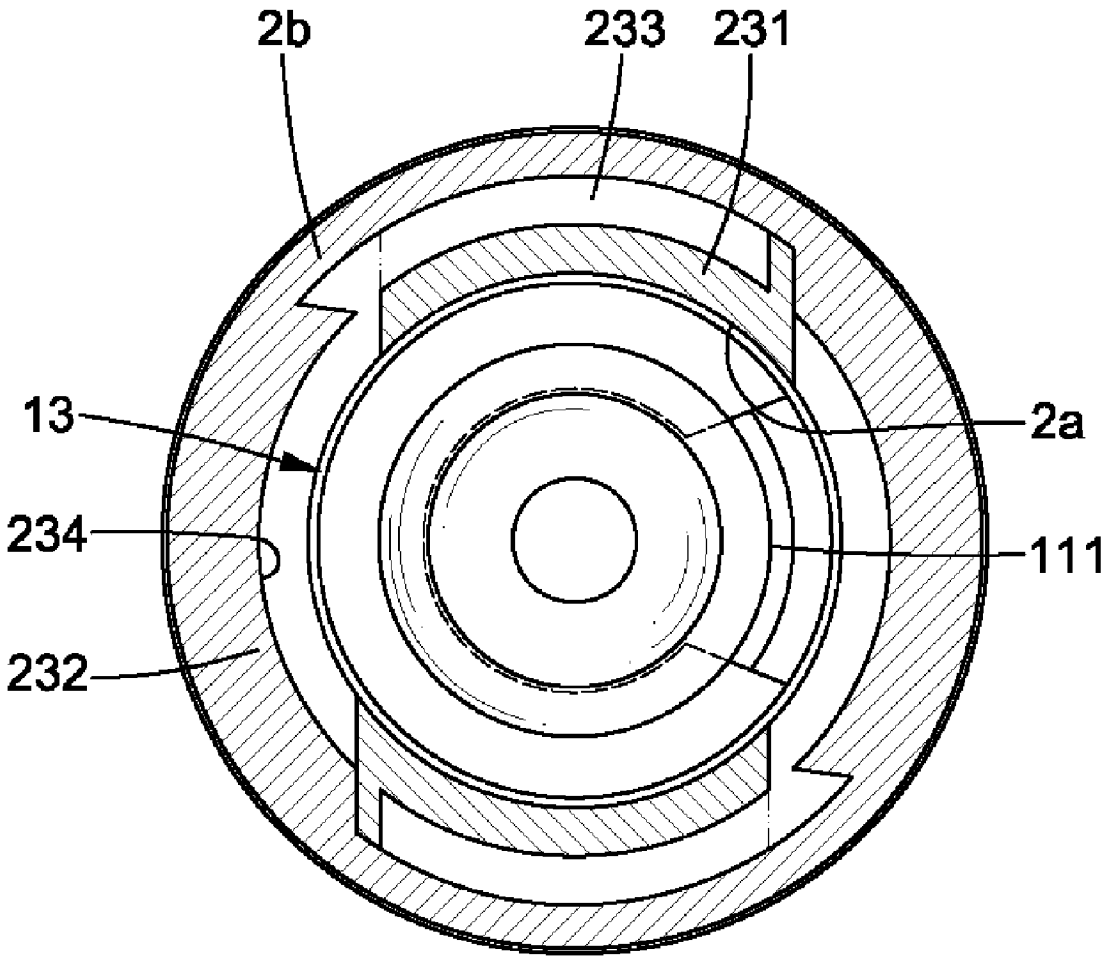
FIG. 5 is a view similar to FIG. 4, illustrating a handle of the pull exerciser before assembly.

In the preferred form shown in FIGS. 2 and 3, a lining ring 13 is mounted around each end 111 of each elastic cord 11. Each lining ring 13 is substantially C-shaped and includes an axial hole 132 delimited by an inner periphery thereof and an opening 133 between two distal ends of the lining ring 13. The inner periphery of each lining ring 113 is conic and tapers outward. Specifically, a minimum inner diameter of the axial hole 132 of each lining ring 13 is smaller than the maximum outer diameter of an associated end 111 of an associated elastic cord 11 having a plug 12 mounted therein. Thus, the respective ends 111 of the respective elastic cords 11, the respective outer layers 13, and the respective plugs 12 can be inserted into and securely retained in the respective axial holes 132 of the respective lining rings 113. Namely, the respective lining rings 113 can be securely mounted around the respective ends 111 of the respective elastic cords 11.

Each handle 2 includes a longitudinal hole 21 and two ends 22 for securely receiving two adjacent ends 111 respectively of a pair of elastic cords 11 adjacent to each other. In the preferred form shown, each handle 2 includes a first handle part 2*a* and a second handle part 2*b* releasably engaged with the first handle part 2*a* by a locking mechanism 23 including male and female couplers 232. Each handle part 2*a*, 2*b* includes an inner end 24 and an outer end 22 having an end opening 211 through which an associated end 111 of an associated elastic cord 11 extends. The outer end 22 of each handle part 2*a*, 2*b* has an inner diameter smaller than an outer diameter of an associated lining ring 13. Thus, the respective lining rings 13 are held in the respective longitudinal holes 21 of the respective handles 2. In the most preferred form shown, the first handle part 2*a* includes two circumferentially spaced protrusions 231 formed on an end face of the inner end 24 thereof. Each protrusion 231 includes a groove 233 in an outer periphery thereof and having an open end (not labeled) and a closed end (not labeled). In the most preferred form shown, the inner end 24 of each second handle part 2*b* includes two circumferentially spaced ribs 234 on an inner periphery thereof. The respective ribs 234 of the second handle part 2*b* are inserted through the open ends of the respective grooves 233 of the first handle part 2*a* into the respective groves 233 of the first handle part 2*a* until they are stopped by the closed ends of the respective grooves 233. Thus, the first and second handle parts 2*a* and 2*b* can be assembled together to form a handle 2. Disengagement between the first and second handle parts 2*a* and 2*b* according to the teachings of the present invention is less likely to occur unless a rotational force is applied.

In the preferred form shown, each handle part 2*a*, 2*b* includes a reduced section 212 for retaining the associated lining member 13 in place. The reduced section 212 includes a minimum inner diameter smaller than the outer diameter of the associated lining member 13. In the preferred form shown, the reduced section 212 is in the form of a shoulder to which the associated lining member 13 abuts against. Alternatively, the reduced section 212 may include a conic inner periphery that tapers outward for retaining the associated lining ring 13 or the associated end 111 of the associated elastic cord 11. Thus, the respective handles 2 are securely and reliably coupled with the respective elastic cords 11.

Before assembly, the first handle part 2*a* and the second handle part 2*b* of each handle 2 are separate from each other. In assembly, the respective ends 111 of the respective elastic cords 11 are inserted into the respective end openings 211 of the respective handle parts 2*a* and 2*b*. Then, the respective lining rings 13 are mounted around the respective ends 111 of the respective elastic cords 11 which are then pulled outward to move the respective lining rings 13 to abut against the respective shoulders of the respective handle parts 2*a* and 2*b*. The respective first and second handle parts 2*a* and 2*b* are engaged together to form the respective handles 2.

Figure 6:
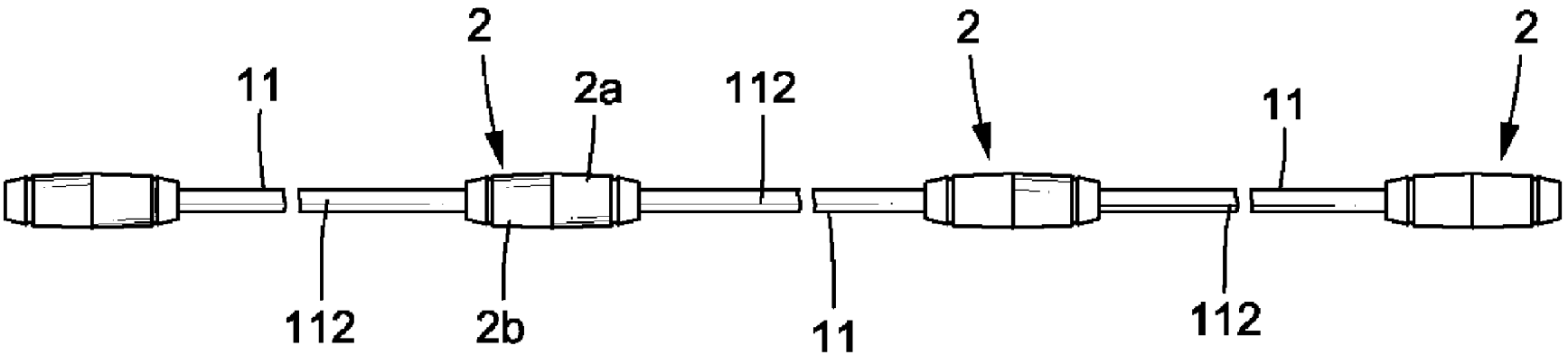
FIG. 6 is a side view illustrating another example of the pull exerciser according to the preferred teachings of the present invention.

In the example shown in FIG. 1, the elastic cords 11 are connected in series by the handles 2 to form a loop. Nevertheless, one of the elastic cords 11 can be detached to provide a linear pull exerciser shown in FIG. 6; namely, the elastic cords 11 are connected in series in a line, and each of two outermost handles 2 of the pull exerciser thus formed has an outer end free of elastic cord.

Figure 7:
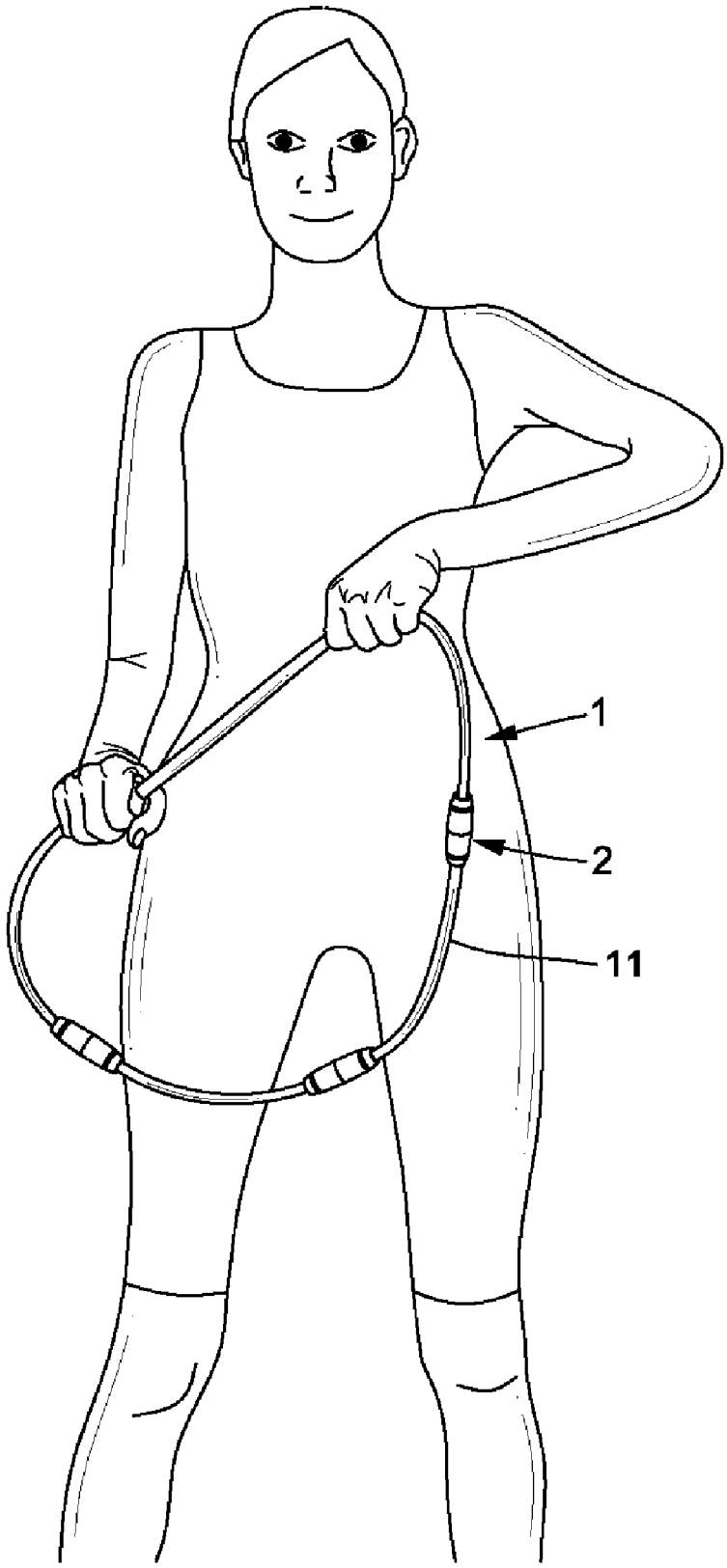
FIG. 7 is a schematic view illustrating use of the pull exerciser in accordance with the present invention.

With reference to FIG. 7, in use of the pull exerciser according to the preferred teachings of the present invention, a user may grip any two of the handles 2 for exercising purposes by repeatedly stretching and releasing the elastic cord(s) 11 between the gripped handles 2. Various exercise effects can be obtained, for the elastic cords 11 have various elastic coefficients. Disengagement of the handles 2 from the elastic cords 11 is less likely to occur, for the respective handles 2 securely hold the respective ends 111 of the respective elastic cords 11. Safe use is provided.

A pad or the like may be provided on or fixed to the outer surfaces of the respective handles 2 to increase friction for firm gripping while providing comfortable touch.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A pull exerciser comprising:

a plurality of elastic cords of different elastic coefficients, with the plurality of elastic cords being connected in series, with each said elastic including two ends; and a plurality of handles, with adjacent ends respectively of a pair of elastic cords adjacent to each other being securely held by an associated one of the plurality of handles, with each said handle including a longitudinal hole having two end openings, with each said end opening being extended through by and associated one of the ends of an associated one of the plurality of elastic cords and having a minimum inner diameter smaller than a maximum outer diameter of the associated end of the associated elastic cord, thereby securely engaging the adjacent ends of the pair of elastic cords and an associated one of the handles together, with each said handle including a first handle part and a second handle part, with each of the first and second handle parts including an outer end defining the end opening, with each of the first and second handle parts including an inner end, and with the inner ends of the first and second handle parts being releasably coupled with each other, with the inner end of each said first handle part including a first protrusion formed on an end face thereof, with the first protrusion including a groove defined in an outer periphery thereof and having an open end and a closed end, with the inner end of each said second handle part including a first rib on an inner periphery thereof, and with the first rib being insertable through the open end of the groove into the groove of the first protrusion for coupling the first and second handle parts together.

2. A pull exerciser as claimed in claim 1, with the plurality of elastic cords being connected to form a loop.

3. The pull exerciser as claimed in claim 1, with the plurality of elastic cords being connected in a line, and with the outer end of the first handle part of one of two outermost handles and the outer end of the second handle part of another of the two outermost handles being free of elastic cords.

4. The pull exerciser as claimed in claim 1, with the axial hole of each said lining ring being delimited by a conic inner periphery that tapers outward.

5. The pull exerciser as claimed in claim 4, with each said end of each said elastic cord being tubular and having a plug mounted therein, with the plug including an outer diameter tapering outward, with the outer diameter of the plug being greater than an inner diameter of an associated one of the ends of an associated one of the elastic cords, and with an overall outer diameter of the associated end of the associated elastic cord having the plug mounted therein being greater than the minimum inner diameter of an associated one of the lining rings.

6. The pull exerciser as claimed in claim 5, with each said end of each said elastic cord being folded outward and backward to form a folded, outer layer having a length greater than the associated plug.

7. The pull exerciser as claimed in claim 1, with the inner end of each said first handle part further including a second protrusion formed on the end face thereof and circumferentially spaced from the first protrusion, with the second protrusion including a groove defined in an outer periphery thereof and having an open end and a closed end, with the inner end of each said second handle part including a second rib on the inner periphery thereof and circumferentially spaced from the first rib, and with the second rib being insertable through the open end of the groove of the second protrusion into the groove of the second protrusion for coupling the first and second handle parts together.

8. The pull exerciser as claimed in claim 3, with each of the first and second handle parts further including a lining ring mounted in the outer end thereof, with each said lining ring having an outer diameter greater than the minimum inner diameter of an associated one of the end openings, with each said lining ring including an axial hole having the minimum inner diameter smaller than the maximum outer diameter of the associated end of the associated elastic cord.

9. The pull exerciser as claimed in claim 8, with each of the first and second handle parts including a reduced section in the outer end thereof, and with the reduced section having an inner diameter smaller than the outer diameter of an associated one of the lining rings.

10. The pull exercised as claimed in claim 9, with each said lining ring being substantially C-shaped, and with the axial hole of each said lining ring being delimited by a conic inner periphery that tapers outward.

11. The pull exerciser as claimed in claim 1, with each of the first and second handle parts further including a lining ring mounted in the outer end thereof, with each said lining ring having an outer diameter greater than the minimum inner diameter of an associated one of the end openings, with each said lining ring including an axial hole having the minimum inner diameter smaller than the maximum outer diameter of the associated end of the associated elastic cord.

12. The pull exerciser as claimed in claim 11, with each of the first and second handle parts including a reduced section in the outer end thereof, and with the reduced section having an inner diameter smaller than the outer diameter of an associated one of the lining rings.

13. The pull exercised as claimed in claim 12, with each said lining ring being substantially C-shaped, and with the axial hole of each said lining ring being delimited by a conic inner periphery that tapers outward.

14. The pull exerciser as claimed in claim 7, with each of the first and second handle parts further including a lining ring mounted in the outer end thereof, with each said lining ring having an outer diameter greater than the minimum inner diameter of an associated one of the end openings, with each said lining ring including an axial hole having the minimum inner diameter smaller than the maximum outer diameter of the associated end of the associated elastic cord.

15. The pull exerciser as claimed in claim 14, with each of the first and second handle parts including a reduced section in the outer end thereof, and with the reduced section having an inner diameter smaller than the outer diameter of an associated one of the lining rings.

16. The pull exercised as claimed in claim 15, with each said lining ring being substantially C-shaped, and with the axial hole of each said lining ring being delimited by a conic inner periphery that tapers outward.

* * * * *